US011800965B2

(12) United States Patent
Klug et al.

(10) Patent No.: US 11,800,965 B2
(45) Date of Patent: Oct. 31, 2023

(54) DRYING APPLIANCE

(71) Applicant: DORAI HOME, INC., West Valley City, UT (US)

(72) Inventors: Jason Charles Klug, Salt Lake City, UT (US); Aaron Basil Nelson, Salt Lake City, UT (US); Kelsey O'Callaghan, Salt Lake City, UT (US)

(73) Assignee: Dorai Home, Inc., West Valley City, UT (US)

( * ) Notice: Subject to any disclaimer, the term of this patent is extended or adjusted under 35 U.S.C. 154(b) by 0 days.

(21) Appl. No.: 17/694,319

(22) Filed: Mar. 14, 2022

(65) Prior Publication Data

US 2022/0202272 A1 Jun. 30, 2022

Related U.S. Application Data

(63) Continuation of application No. 16/838,737, filed on Apr. 2, 2020, now Pat. No. 11,272,829.
(Continued)

(51) Int. Cl.

| | |
|---|---|
| ***A47L 19/04*** | (2006.01) |
| *A47F 5/01* | (2006.01) |
| *A47B 81/04* | (2006.01) |

(52) U.S. Cl.
CPC ..... *A47L 19/04* (2013.01); *A47B 81/04* (2013.01); *A47F 5/01* (2013.01)

(58) Field of Classification Search
CPC ..... A47L 19/04; A47L 19/02; A47L 19/00; A47L 15/505; A47L 15/501; A47L 15/50;
(Continued)

(56) References Cited

U.S. PATENT DOCUMENTS 2,708,037 A * 5/1955 Planeta ..... A47L 19/04 211/74
3,580,394 A * 5/1971 Elliot ..... A47G 21/14 248/316.3

(Continued)

FOREIGN PATENT DOCUMENTS

CN 1411618 A 4/2003
CN 205215084 U * 5/2016

(Continued)

*Primary Examiner* — Devin K Barnett
(74) *Attorney, Agent, or Firm* — Headland Law & Strategy; Matthew J. Smyth

(57) ABSTRACT

A drying appliance including a drying rack and a rapidly drying absorptive drain tray assembly. Such embodiments further include adaptable and interchangeable accessories for selectable placement and scaling of the size, amount and placement of features for managing the capacity and location of the drying accessories. The drain tray includes an absorptive base. The absorptive base instantly wicks, absorbs, and evaporates water away from the drying kitchenware to lower relative humidity and to prevent mold and bacteria from growing thereon. The drying rack can include a built-in cutting board holder that provides extra space for pots, pans, and bowls. The drying rack can include modern durable steel rails that can be customized for each person's particular needs. The legs of the drying rack can support the absorptive drain tray above the surface of a counter allowing for 360 degree evaporation.

21 Claims, 11 Drawing Sheets

Related U.S. Application Data

(60) Provisional application No. 62/828,245, filed on Apr. 2, 2019.

(58) Field of Classification Search
CPC ..... A47L 17/00; A47L 15/502; A47L 15/503; A47G 19/08; A47G 23/0208; A47G 23/03; A47G 23/0216; A47G 23/02; A47G 23/0303; A47F 7/0064; A47F 5/01; A47J 47/16; A47J 47/20; A47B 81/04; A47B 55/02; B65D 81/26
USPC ..... 211/41.2–41.6, 41.8, 41.9
See application file for complete search history.

(56) References Cited

U.S. PATENT DOCUMENTS

| | | | | |
|---|---|---|---|---|
| 5,525,436 | A | 6/1996 | Savinell et al. | |
| 10,694,922 | B1 * | 6/2020 | Audibert | A47L 15/505 |
| 2004/0112754 | A1 | 6/2004 | Thate et al. | |
| 2004/0224215 | A1 | 11/2004 | Molter et al. | |
| 2005/0269273 | A1 * | 12/2005 | Yang | A47L 15/502 211/41.4 |
| 2007/0131629 | A1 * | 6/2007 | Sullivan | A47L 19/04 211/41.3 |
| 2008/0156750 | A1 * | 7/2008 | Richardson | A47L 15/505 211/41.9 |
| 2009/0211994 | A1 * | 8/2009 | Yang | A47L 19/04 211/41.3 |
| 2009/0297908 | A1 | 12/2009 | Kohl et al. | |

FOREIGN PATENT DOCUMENTS

| | | | | |
|---|---|---|---|---|
| FR | 671005 | A | * | 12/1929 |
| GB | 397273 | A | * | 4/1975 |
| JP | H11503262 | A | | 3/1999 |
| JP | 2001300324 | A | | 10/2001 |
| JP | 2003007308 | A | | 1/2003 |
| JP | 3204281 | U | * | 5/2016 |
| WO | 9944245 | A1 | | 9/1999 |

* cited by examiner

DRYING APPLIANCE

CROSS-REFERENCE TO RELATED APPLICATIONS

This application claims priority to U.S. Non-Provisional patent application Ser. No. 16/838,737 filed Apr. 2, 2020 and priority to and the benefit of U.S. Provisional Application No. 62/828,245, filed Apr. 2, 2019, contents of both patent applications are incorporated herein by reference in their entirety.

BACKGROUND

In kitchens it is common to use a drying rack adjacent to the kitchen sink for the collection of wet or partially dried dishes subsequent to the manual washing of the dishes in the sink. Typically the dishes are rinsed and placed in specialized compartments in the rack. A series of apertures and/or through slots extend through the bottom of the rack, through which water from the dishes is allowed to drain by gravity.

FIG. 1 illustrates two conventional drying racks 1A and 1B which are generally composed either of rubber or plastic polymer (see 1A) or often polymer coated metal wires (see 1B). In use, a conventional drain tray 10 is positioned beneath the racks 1A and 1B and generally includes a central platform area 13, bounded by raised sidewalls 11, on which the rack 1 is supported. The water dripping from the racked dishes collects upon the platform area 13 of the drain tray 2, out of contact with the dishes, thereby accelerating the draining and drying of the dishes. Some drain trays 2 in common use provide an outlet channel 12 at one end of the platform area 13. The outlet channel 12, or groove, is often directed over a sink. In this way excess water collected by the drain tray 10 can be diverted to the sink. Other drain trays 10 may merely collect the water in the platform area 13, for eventual disposition by way of evaporation or manual emptying.

While the above conventional drying rack 1 and drain tray 10 assemblies are well accepted in the industry and have met with commercial success, several shortcomings prevent existing rack and tray sets from satisfying all of the consumer and manufacturer's needs.

Traditional drying racks 1 and traditional drain trays 10 for drying glassware, dishes, and utensils, for example, are generally prone to remaining wet for long durations of time especially under multiple daily use. Moreover, the extended use of such conventional drying racks 1 and drain tray 10 assemblies are prone to the growth of fungus and bacteria thereon, which may be unhealthy, produce an unpleasant odor, or unpleasant appearance. Additionally, the use of such traditional drying racks 1 and drain tray 10 assemblies may cause spreading of germs and viruses during an extended use and lifetime thereof. And, when used in a facility where multiple meals and dirty dishes are made per day the concerns regarding the likelihood that a drain tray 10 in particular will accumulate and remain wet and promote mold and bacteria growth is of increased concern.

Another concern regarding the design of the drying rack 1 is the accommodation of different sizes and shapes of dishes, glassware, utensils, and even cutting boards. This limited adaptability of the conventional drying rack 1 design can be further exasperated where the applicable drying requirements extend beyond the typical sizes and shape of the average dinnerware set. For example, in some instances the ability to accommodate the bottles, bowls, plates, and utensils of infants are limited by the conventional design of the drying rack 1 to hold 6-12 inch plates, traditional knives, forks, bowls, and glassware for older people. As another example, a user may desire to clean and dry pet food containers such as food and water bowls which may not be adapted for use in a conventional drying rack 1 configuration.

Moreover, often certain consumers are not able to customize the conventional drying rack layout, size, and are unable to accommodate certain wine, champagne, martini, or other glassware. Moreover, a household may use an inordinate amount of utensils for example, as compared to reusing or disposal of drinkware. And, the conventional drying rack 1A and 1B are not typically readily adaptable for drying different sizes and shapes of a cutting board, or length and size of a knife. Rather, referring still to FIG. 1, the shape, design, and layout of the conventional drying rack 1 is fixed upon manufacture. That is, the layout and capability of the various features of the conventional drying rack 1 are set upon manufacture are not reconfigurable for a particular use of individual's needs.

Moreover, often the conventional drying rack 1 may not consider whether the drying rack 1 is to be used on the left or right side of a sink. The layout of the drying rack 1 traditionally did not consider the variable placement of components thereon. The drying rack 1 was not reconfigurable for the particular arrangement of dishes, utensils, or even a cutting board so as to optimize the access to the sink and counter as well as the kitchenware being dried. The ability to adjust the angle, slope, and configuration of the drain tray 10 relative to the drying rack 1 has also traditionally be fixed.

Accordingly, there exists a need for an improved drying appliance including an improved drying rack and drain tray assembly, such as adjacent to sinks in kitchens, which avoids hygiene related problems that may occur due to an extended use of the often saturated drain tray. There also exists a need for a new design of drain tray that dries rapidly so as to wick and draw moist air and liquid away from the dishes so as to further increase the rate of which the dishes dry. There is also a need for improved drain tray layout and customized and reconfigurable design and layouts. Such environments and concerns are illustrative of a large genus of applications and concerns discussed herein.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF THE INVENTION

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

An appliance is disclosed including a drying rack and an absorbent drain tray. The drying rack can include a base having a plurality of apertures there through allowing for rinse water from kitchenware placed thereupon to drain onto the absorbent drain tray. The drying rack can include a plurality of supports for supporting washed kitchenware. The apertures of the base can also provide support structures for the washed and rinsed kitchenware. The absorbent drain tray is disposed underneath the base of the drying rack and absorbs the rinse water drained from the kitchenware. By absorbing the rinse water, the absorbent drain tray wicks the moisture away from the surface of the absorbent drain tray upon which the rinse water is drained upon.

The absorbent drain tray includes diatomaceous earth. The rapid drying drain tray can include the rapidly wicking and drying earth material called diatomaceous earth. Diatomaceous earth—also known as D.E., diatomite, or kieselgur/kieselguhr—is a naturally occurring, soft, siliceous sedimentary rock that is traditionally easily crumbled into a fine white to off-white powder. It has a particle size ranging from less than 3 μm to more than 1 mm, but typically 10 to 200 μm. Depending on the granularity, this powder can have an abrasive feel, similar to pumice powder, and has a low density as a result of its high porosity. The typical chemical composition of oven-dried diatomaceous earth is 80-90% silica, with 2-4% alumina (attributed mostly to clay minerals) and 0.5-2% iron oxide.

Diatomaceous earth consists of fossilized remains of diatoms, a type of hard-shelled protist (chrysophytes). As disclosed herein the layer or component of diatomaceous earth of the mat is used as an absorbent and rapid evaporator for liquids. The thermal properties of diatomaceous earth also enable it to be used as the barrier material according to several embodiments disclosed herein.

For example, several embodiments disclosed herein include a diatomaceous earth layer or component forming the drain tray. In some embodiments, the entire drain tray can be made of diatomaceous earth. While a drain tray comprising diatomaceous earth is disclosed herein other products and kitchenware can be similarly configured. The placement of the diatomaceous earth layer or component immediately below the drying rack component allows for the diatomaceous earth to rapidly wick and absorb the moisture away from the dishes, glassware, and utensils thereby rapidly removing saturation of water from the drying environment. Once absorbed by the diatomaceous earth layer, the repeated saturation of the drain tray is more rapidly evaporated and dried as compared to traditional drying rack and drain tray assemblies. The diatomaceous earth absorbs moisture dripped upon the absorbent drain tray by the kitchenware and wicks moisture within the absorbent drain tray and away from the surface of drain tray upon which the water is drained upon.

The drying rack can include a plurality of legs for supporting the drying rack upon a surface of a kitchen counter. The legs can include a seat extending inward for supporting the absorbent drain tray and cushioned appendages for supporting the drying rack and drain tray upon a countertop without scratching the countertop. As such, the drain tray does not rest directly upon the counter top as opposed to traditional drain trays. The support to the drain tray by the legs of the drain tray further provides for 360 degree evaporation of the absorbed rinse water. That is, the absorbed rinse water is allowed to evaporate from the entire outer surface of the absorbent drain tray.

The drying rack can include upwardly extending rails disposed near opposing ends of the drying rack. The upwardly extending rails can be connected to, or formed integral with, downwardly extending legs. Two upwardly extending rails can be connected by a beam extending along a length of the drying rack. The upwardly extending rails can be connected by two beams extending across a width of the drying rack. A drying accessory is shaped to be placed upon the two beams extending across the width of the drying rack.

The appliance can include a plurality of interchangeable drying accessories, the drying accessories being interchangeably attached to the beams of the drying rack. The drying accessories can include one or more glassware hangers for hanging glassware thereon. The one or more glassware hangers can include a polymer cover disposed over an end thereof to protect and cushion glassware place thereon for drying. The drying accessories can include a utensil compartment for placement of washed utensils therein and can include a large kitchen knife drying accessory. The large kitchen knife drying accessory includes a wooden portent and a cushioning polymer portion, the cushioning polymer portion providing an internal cushion for a tip of the large kitchen knife.

The upwardly extending rails and downwardly extending legs can be welded to the base or can be pivotally attached to the base of the dishrack so as to be collapsible into a reduced height. The drying rack can include a secondary base disposed below the main base, the secondary base including apertures there through, the length of apertures in the secondary base being smaller than the apertures of the base disposed directly above the secondary base so as to allow kitchenware to extend through the base and be supported by the base while being further supported by the relatively smaller apertures of the secondary base. The drying rack can include a peripheral rail having connectors disposed at opposing ends thereof for connecting the ends of the peripheral rail to the upwardly extending rails. And, the base of the drying rack including an extended aperture, the extended aperture extending along a length of the base and being sized to allow a cutting board to extend there through. The base of the drying rack includes apertures of increased length for supporting larger dishware and apertures of decreased length for supporting smaller dishware.

And, the drying rack and absorbent drain tray can be substantially rectangular in shape with rounded corners. The use of the diatomaceous earth drain tray results in more rapid and complete evaporation of water from dishes, utensils, and cutlery held by the drying rack. And a lateral support connects two ends of the drying rack and which also provides lateral support to a cutting board or other larger dish held within a recessed receptacle a base rack portion of the drying rack. The drain tray can include channels for diverting water to one or more outlets. The drain tray can include multiple outlets for selective diversion of water depending on a selectable tilt angle of the train tray. However, the drain tray does not include one or more outlets according to some embodiments.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION

Figure 1:
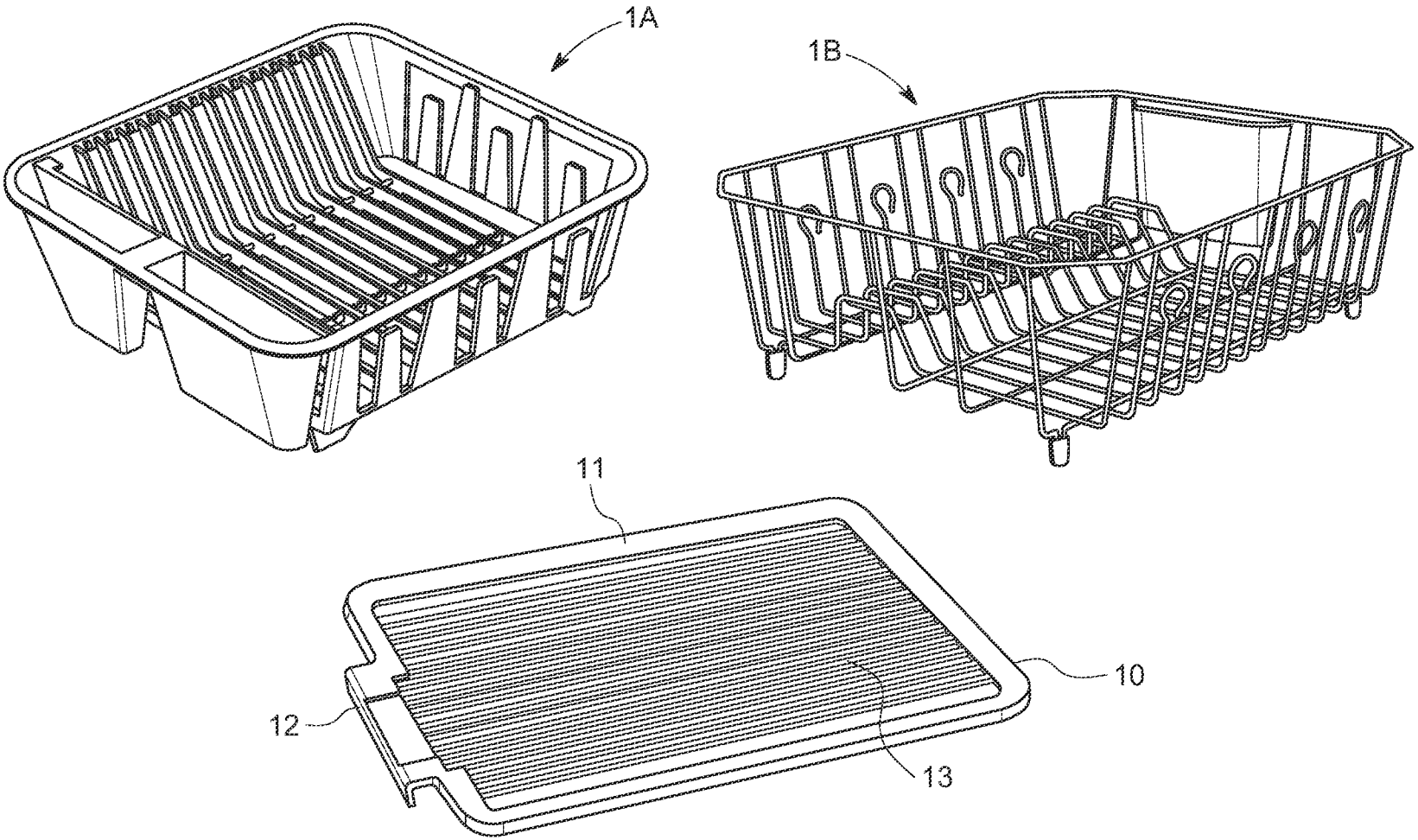
FIG. 1 (PRIOR ART)
FIG. 1 illustrates a conventional drying rack and drain tray.

Embodiments of the invention relate to a drying appliance including a drying rack and a rapidly drying drain tray assembly. Such embodiments further include adaptable and interchangeable accessories for selectable placement and scaling of the size, amount and placement of features for managing the capacity and location of the drying accessories. The embodiments disclosed herein enable advantageous manufacturing processes, designs, and assemblies of components, materials, and manufactures.

As previously discussed the old wire baskets and moldy plastic bins are prone to retaining moisture drained from such conventional drying racks. This retained moisture is prone to collecting mold and bacteria over repeated use thereof. Moreover, the utility of the drying features of the traditional drying rack is set upon manufacture and is not customizable, nor modular, as compared to various innovative embodiments disclosed hereinafter and shown in the drawings. The combined improvements provided by the embodiments illustrated herein is a modern way to dry hand-washed dishes with customizable accessories. Examples, of such selectable and rearrangable accessories can including knife holders, bottle or cup holders, and a utensil cage, or multiples thereof, for example. The positioning and arrangement of such accessories can be placed around and fitted to one or more peripheral racks or rails. The peripheral racks and rails can provide support to the modular accessories as well as other kitchenware such as a cutting board, dishware including bowls, plates, and cups.

The drain tray includes an absorptive base. The absorptive base instantly wicks, absorbs, and evaporates water away from the drying kitchenware to lower relative humidity and to prevent mold and bacteria from growing thereon. The drying rack can include a built-in cutting board holder that provides extra space for pots, pans, and bowls. The drying rack can include modern durable steel rails that can be customized for each person's particular needs from home chefs, to athletes, to new moms and dads. The accessories can be purchased, used, and arranged individually, for example. Such unique drying rack design helps keep the sink space clean.

The drying rack design helps keep dishes organized and secure, dries them quickly and helps keep the area around a sink clean. Moreover, conventional drying racks are particularly prone to aging including rust, plastic fatigue, and breakage. The drying rack and drain tray are also nicely styled and don't look like the conventional designed in the 1930's. The dish rack is well constructed, sturdy and there is no need to worry about rust. The diatomaceous earth base of the drain tray wicks up water and dries very quickly.

Accessories for the drying rack can include any arrangement and selection of accessories. For example, one set might include a knife block, two bottle/cup holders, and a utensil cage depending on the dimensions of the drying rack. According to one illustrative embodiments, some examples of dimensions can include a length of 22.52 inches (57.2 cm), a width of 16.54 inches (42 cm) and a height 6.34 inches (16.1 cm).

Some embodiments disclosed herein are directed to the manufacture and assembly of a composite drying rack, drain tray assembly, and accessories as well as intermediate manufactures, features, and parts thereof. The drying rack and drain tray assembly can be in the form of multiple assembled parts in the form of a drying rack made of a plastic, metallic, and/or wood component(s) with a drain tray comprising a wicking absorptive earth element. The composite parts, elements, and modular accessory adaptors may be manufactured from distinct materials and assembled together. Assembly of one or more components can include mechanical features for assembling and fastening the components or layers together or the components can be connected such as by welds, joints, connectors, or fasteners. The shape of the drying rack, modular components, and draining tray may interrelate in that outer and inner periphery attachments and components may correspond, or fit, with a shape of another component such that when assembled the composite assembly can be an aesthetically pleasing, more adaptable, and functionally superior to the conventional designs previously discussed.

The rapid drying drain tray can include the rapidly wicking and drying earth material called diatomaceous earth. Diatomaceous earth—also known as D.E., diatomite, or kieselgur/kieselguhr—is a naturally occurring, soft, siliceous sedimentary rock that is traditionally easily crumbled into a fine white to off-white powder. It has a particle size ranging from less than 3 μm to more than 1 mm, but typically 10 to 200 μm. Depending on the granularity, this powder can have an abrasive feel, similar to pumice powder, and has a low density as a result of its high porosity. The typical chemical composition of oven-dried diatomaceous earth is 80-90% silica, with 2-4% alumina (attributed mostly to clay minerals) and 0.5-2% iron oxide.

Diatomaceous earth consists of fossilized remains of diatoms, a type of hard-shelled protist (chrysophytes). As disclosed herein the layer or component of diatomaceous earth of the mat is used as an absorbent and rapid evaporator for liquids. The thermal properties of diatomaceous earth also enable it to be used as the barrier material according to several embodiments disclosed herein.

For example, several embodiments disclosed herein include a diatomaceous earth layer or component forming the drain tray. In some embodiments, the entire drain tray can be made of diatomaceous earth. While a drain tray comprising diatomaceous earth is disclosed herein other products and kitchenware can be similarly configured. The placement of the diatomaceous earth layer or component immediately below the drying rack component allows for the diatomaceous earth to rapidly wick and absorb the moisture away from the dishes, glassware, and utensils thereby rapidly removing saturation of water from the drying environment. Once absorbed by the diatomaceous earth layer, the repeated saturation of the drain tray is more rapidly evaporated and dried as compared to traditional drying rack and drain tray assemblies.

Figure 2:
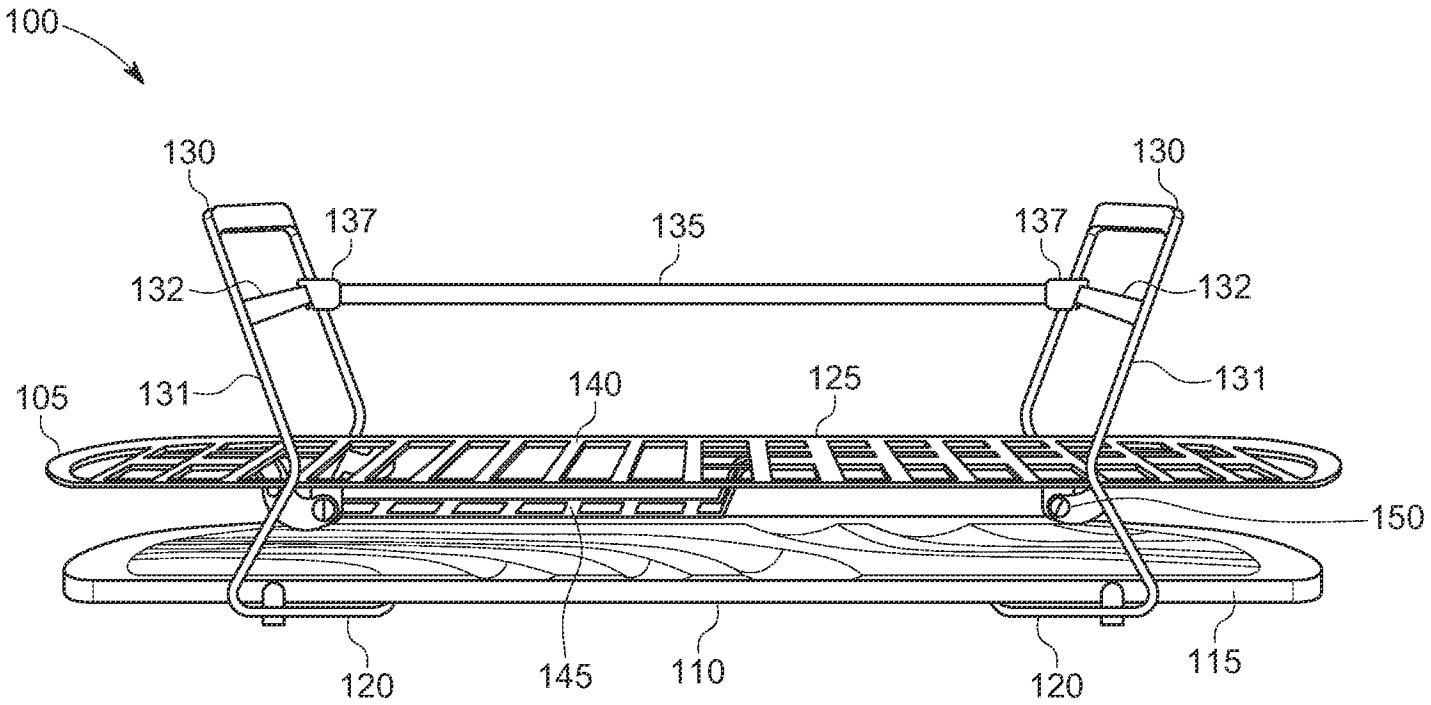
FIG. 2 illustrates an appliance including a drying rack and drain tray.
Figure 3:
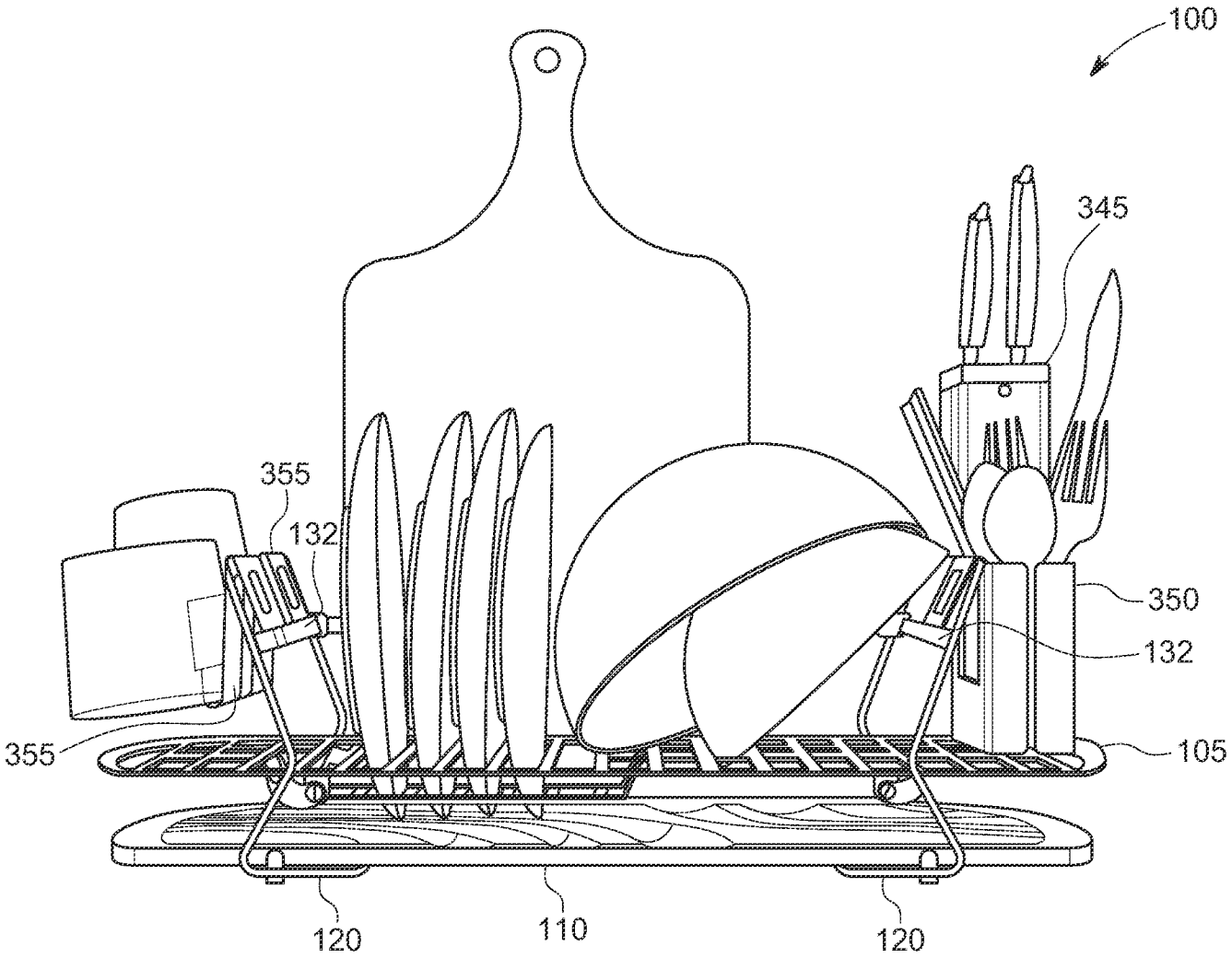
FIG. 3 illustrates the appliance including the drying rack and drain try along with several accessories for supporting kitchenware after being washed.

Referring to FIGS. 2 and 3, a first example of a drying appliance 100 is shown including a drying rack 105 and a drain tray 110. The drain tray 110 is generally rectangular with rounded corners and has four cutouts 115 for accommodating and locating four downwardly extending and cantilevered legs 120 of the drying rack 105 thereby securely and precisely placing the drain tray 110 relative to the drying rack 105 when assembled. The drain tray 110 is made of a diatomaceous earth wicking material as opposed to the molded plastic or rubber polymer material of the prior art thereby more rapidly drawing moisture away from dishes, glassware, and utensils placed upon the drying rack 105 as shown in FIG. 3. The use of the diatomaceous earth drain tray 110 results in more rapid and complete evaporation of water from the kitchenware, drying rack 105, and drain tray 110.

The drying rack 105 can be generally rectangular with rounded corners, having a base rack 125 and opposing downward angled end supports 130 made of metal rails. The end supports 130 can be further connected together by a lateral support rail 135 which also provides lateral support to a cutting board or other larger dish held within a recessed receptacle of the base rack 125. The recessed receptacle can extend along a length of the drain tray 105 thereby allowing for additional placement of dishes within the base rack 125 and perpendicular thereto.

Figure 4:
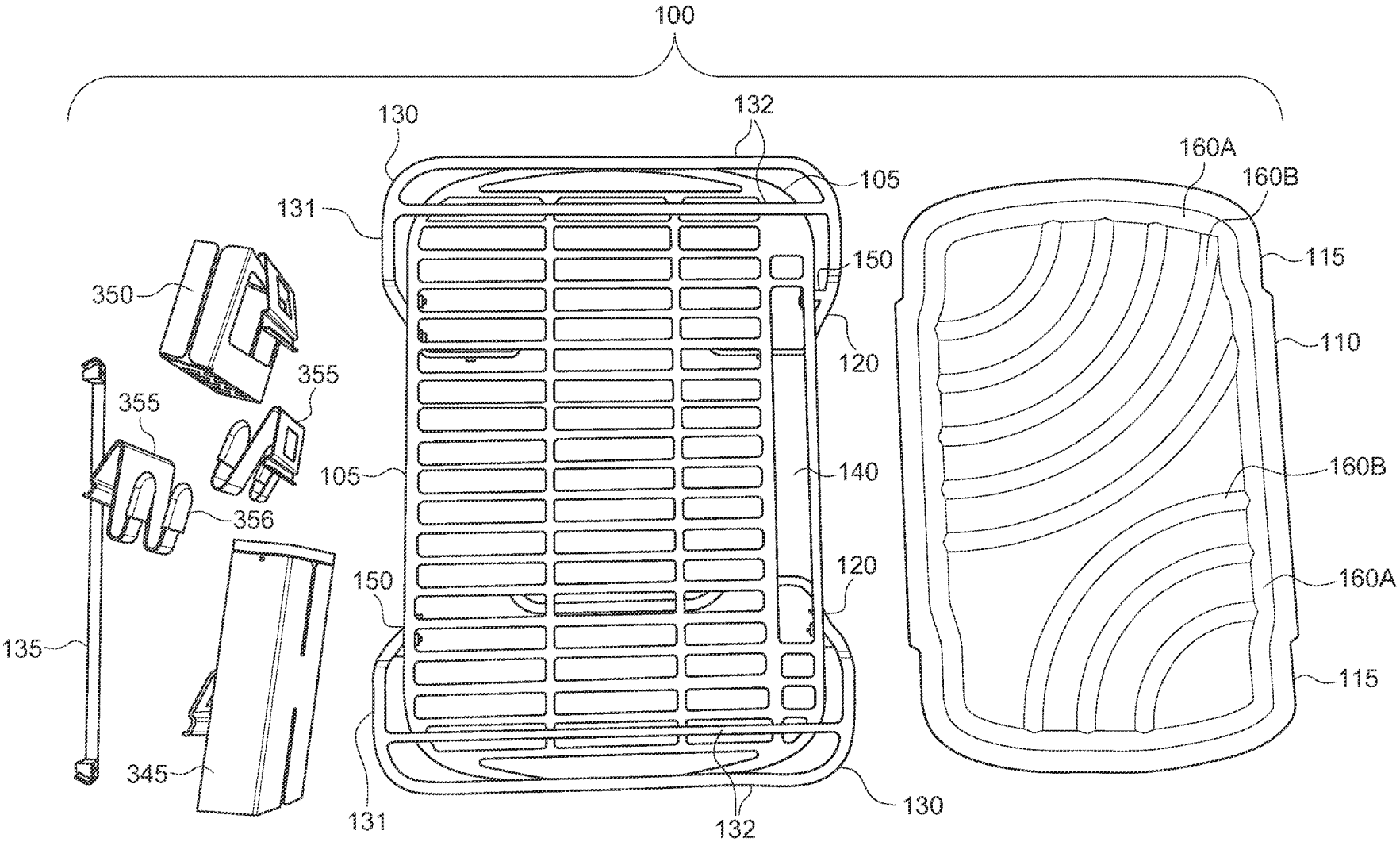
FIG. 4 illustrates examples of components of the unassembled appliance.

Referring to FIGS. 4, 5A, 5B, and 5C, the drying appliance 100 can include various assemblable and connectable modular attachments. The use of interchangeable modular attachments that can be interchangeable, customized, and optimized in placement, type, and size can be optimal to various households. As shown in FIGS. 4 and 5, the attachments can include a cutlery attachment 345, a utensil attachment 350, and two glassware attachments 355. Other attachments can be interchangeable and used for accommodating many different objects, dishes, bowls, glassware, cutlery, bottles, tools, and custom configurations for special applications and purposes. Moreover, as previously discussed, the location of the assembly 100 relative to a sink, counter, or placement layout is easily reconfigurable according to the teachings disclosed herein.

Figure 5C:
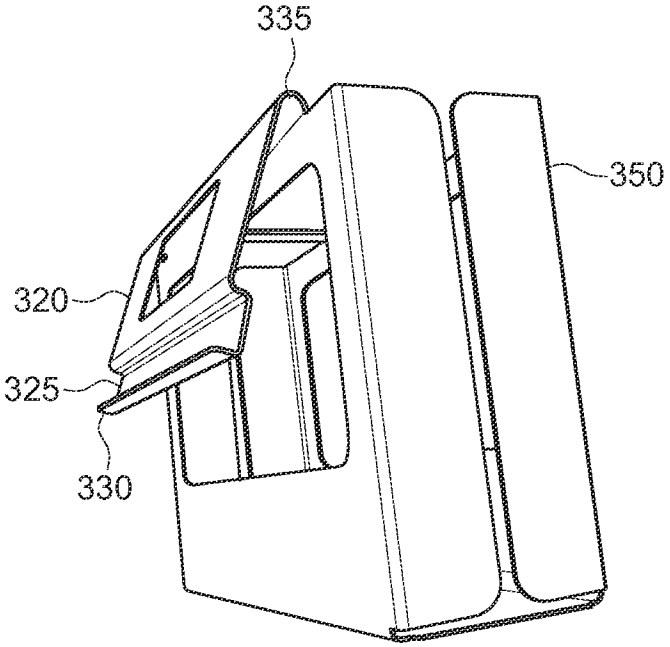
FIGS. 5A, 5B, and 5C illustrate some examples of hanging accessories for supporting utensils (FIG. 5A), glassware (FIG. 5B), and cutlery (FIG. 5C)
Figure 5B:
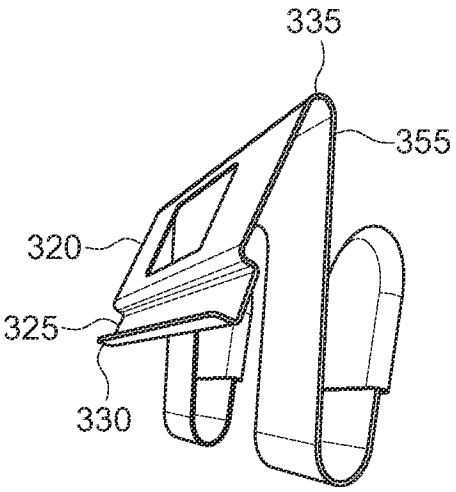
Figure 5A:
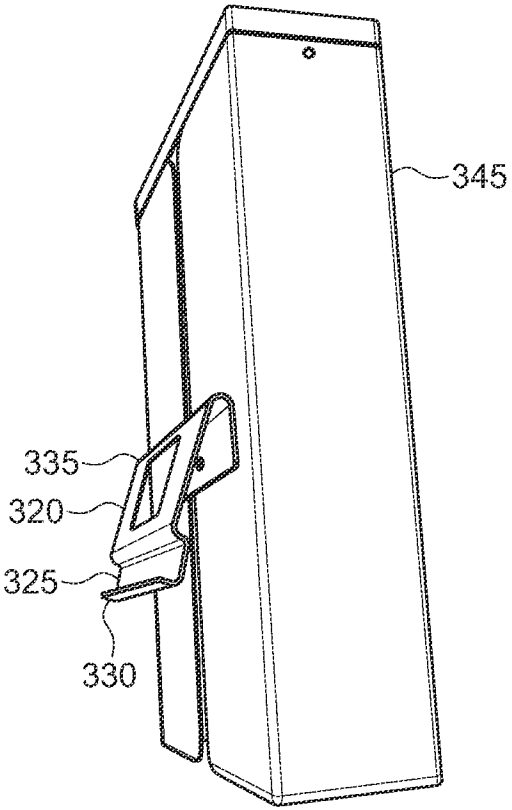

As best shown in FIGS. 4-6 the location of the various connectable modular apparatus for supporting different kinds of kitchenware may be selectively moved based on any criteria. In this embodiment, each attachment includes a hanger 320. The hanger 320 can be formed with, attached to, welded, or otherwise connected to the attachments 345, 350, and 355. The hanger 320 can be universal in shape for multiple different accessories. The shape of the hanger 320 can conform and work in placement upon the size and position of the transverse rails 132 of the drying rack 105. For example, the hanger 320 can include a trough 325 and tongue 330 that fit around a lowermost transverse rail 132 of the drying rack 105. The uppermost portion of the hanger 320 can include a bend 335 that extends over and hangs from the uppermost transverse rail 132 of the drying rack 105 as best shown in FIGS. 5A, 5B, and 5C. As such, the weight of the accessory and kitchenware held is suspended from the end support rails 130 in a secure manner yet allowing for replacement and repositioning of the accessories thereto.

Figure 6C:
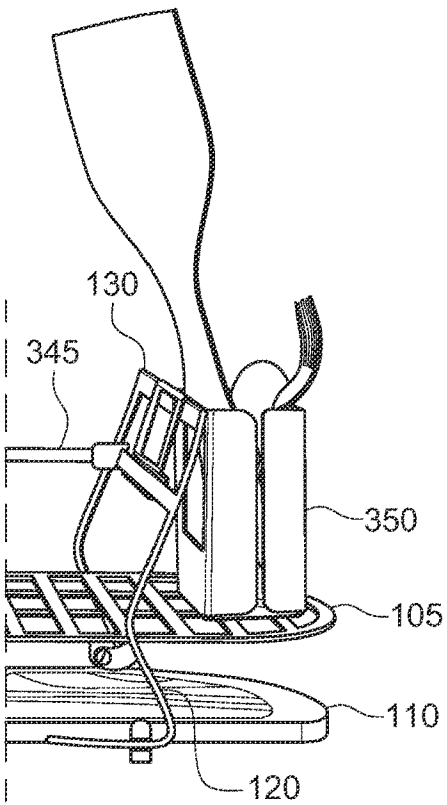
FIGS. 6A, 6B, and 6C illustrate the accessories in a hanging position supported by rails of the drying rack while supporting utensils (FIG. 6A), glassware (FIG. 6B, and cutlery (FIG. 6C)
Figure 6B:
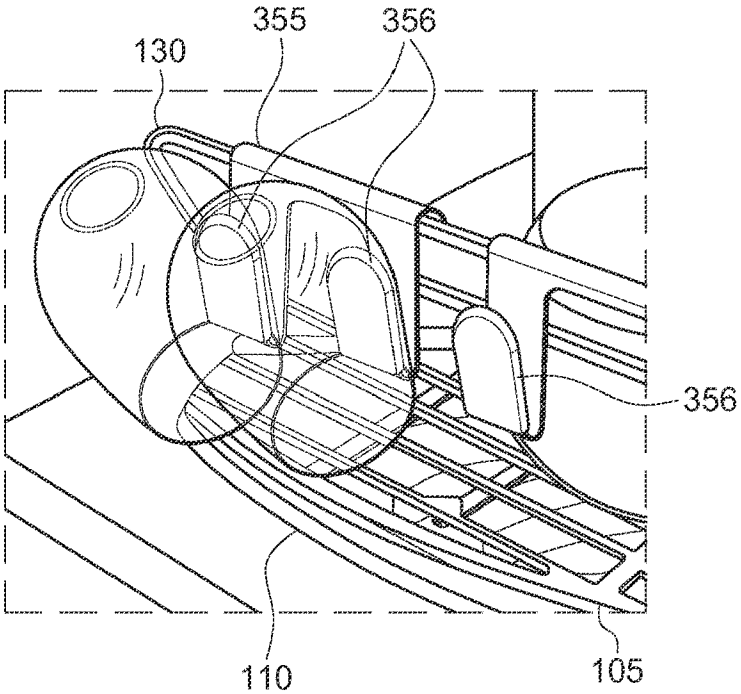
Figure 6A:
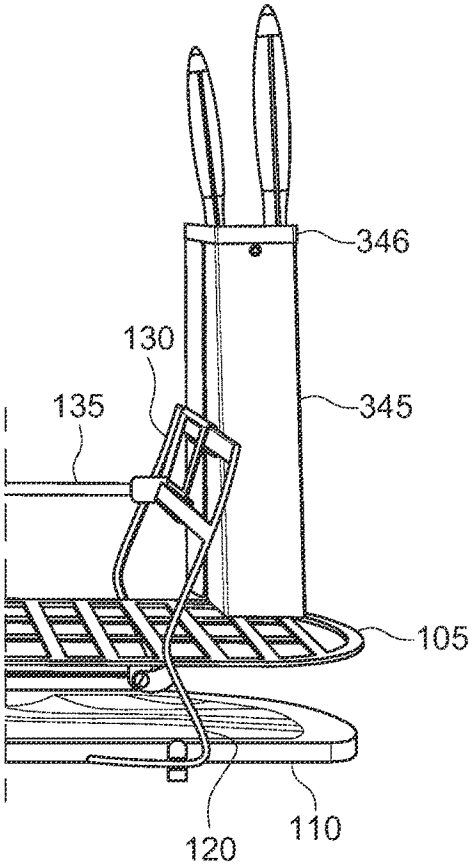

Referring to FIGS. 6A, 6B, and 6C, the modular attachments for glassware 355 are shown in FIG. 6B as extending from a transverse rail 132 at a more vertical direction. Moreover, the attachments for glassware 355 each have a silicone sleeve 356 disposed over the ends thereof for more delicately holding the glassware thereon. Referring to FIG. 6A, the attachment 345 for cutlery can include an insert 346 having an internal end made from a resilient silicone material or other suitable material for engaging the ends of cutlery without damaging the tip thereof.

Figure 7:
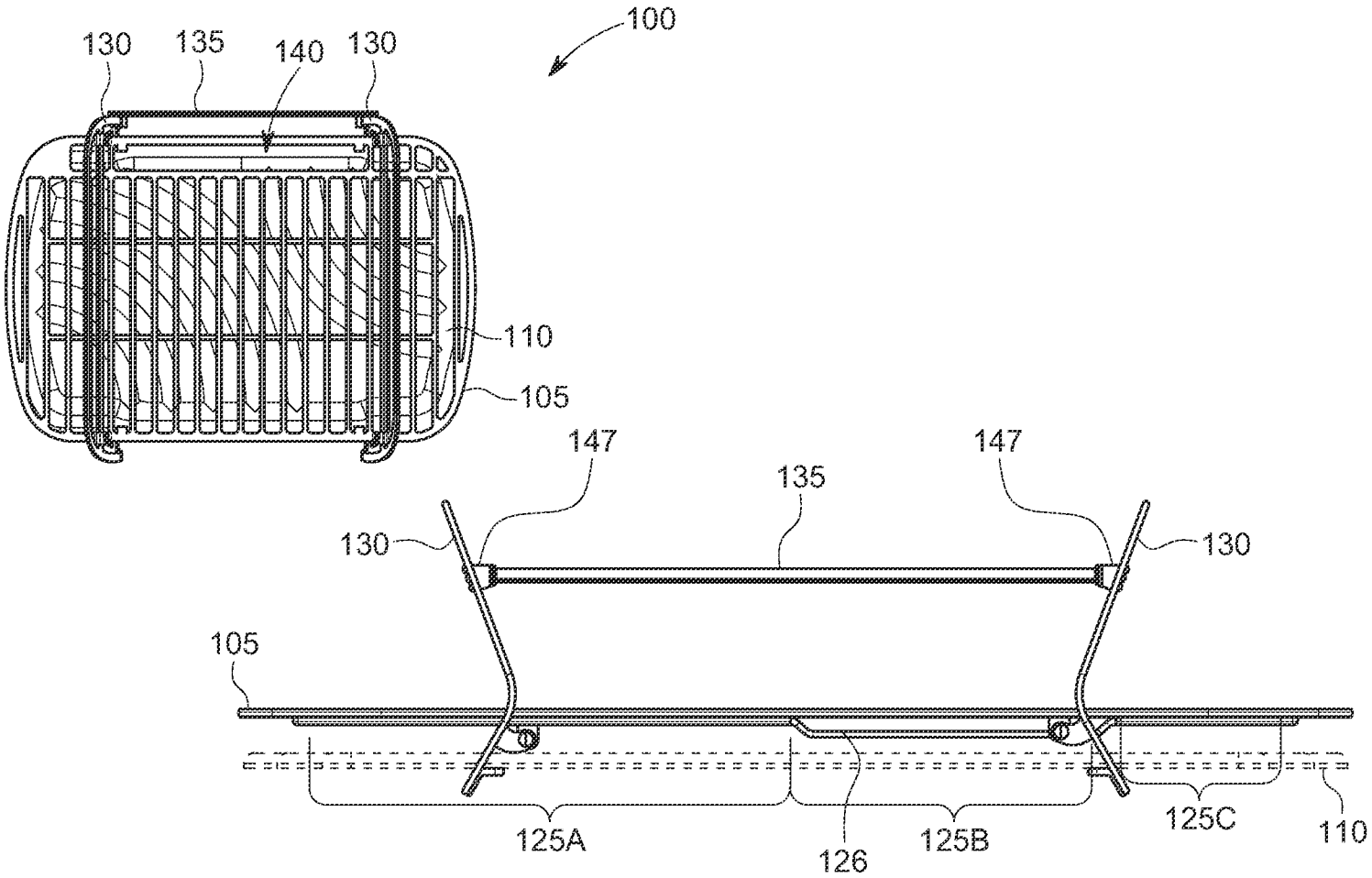
FIG. 7 illustrates a side view and top view of the appliance.

Referring to FIG. 7, the base rack 125 can have certain sections having differently sized apertures from other sections so as to accommodate particular dishes or kitchenware such as pots, pans, etc. For example, as previously discussed the base rack 125 can have a middle section 125B that has longer apertures as opposed to end portions 125A and 125C to allow larger plates and bowels to extend there through to be also supported by a lower rack 126.

The drying rack 105 can be generally rectangular with rounded corners, having a base rack 125 and opposing downward angled end supports 130 made of metal rails. The end supports 130 can be further connected together by a connectable lateral support 135 which also provides lateral support to a cutting board or other larger dish held within a recessed receptacle 140 of the base rack 125. The recessed receptacle 140 can extend along a length of the drain tray 105 thereby allowing for additional placement of dishes within the base rack 125 and perpendicular thereto.

Figure 8:
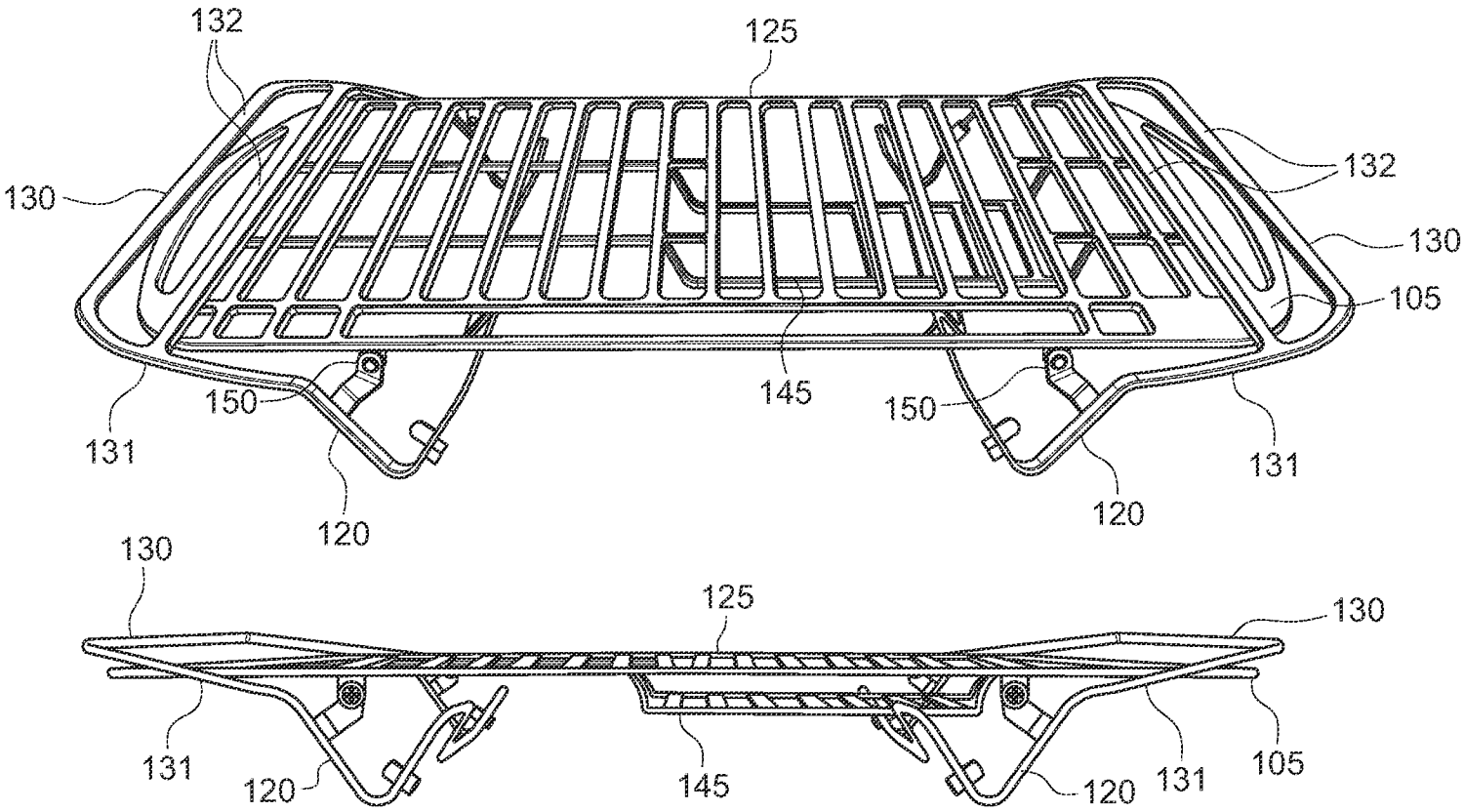
FIG. 8 illustrates the drying rack in a collapsed position where the legs and rails are pivoted into the collapsed position of decreased height.

As shown in FIG. 8, the legs 120 of the drain rack 105 can be pivotally connected to the base rack 125 so as to allow the legs 120 and upwardly extending rails 131 to be pivoted more closely parallel to the base rack 125 so as to reduce the height of the drying rack for packaging. Upon assembly of the drying appliance, for example from the disassembled components shown in FIG. 4, the legs 120 and upwardly extending rails 131 of the drying rack 105 are rotated into the usable position shown in FIG. 7 where the connectors 147 of the lateral support rail 135 are connected to the upwardly extending rails 131 of the end support rails 130 thereby holding the upwardly extending rails 131 in place for placement of the accessories. The lateral support rail 135 also providing support for the cutting board there against where the cutting board is placed within the longitudinal aperture 140.

Figure 9:
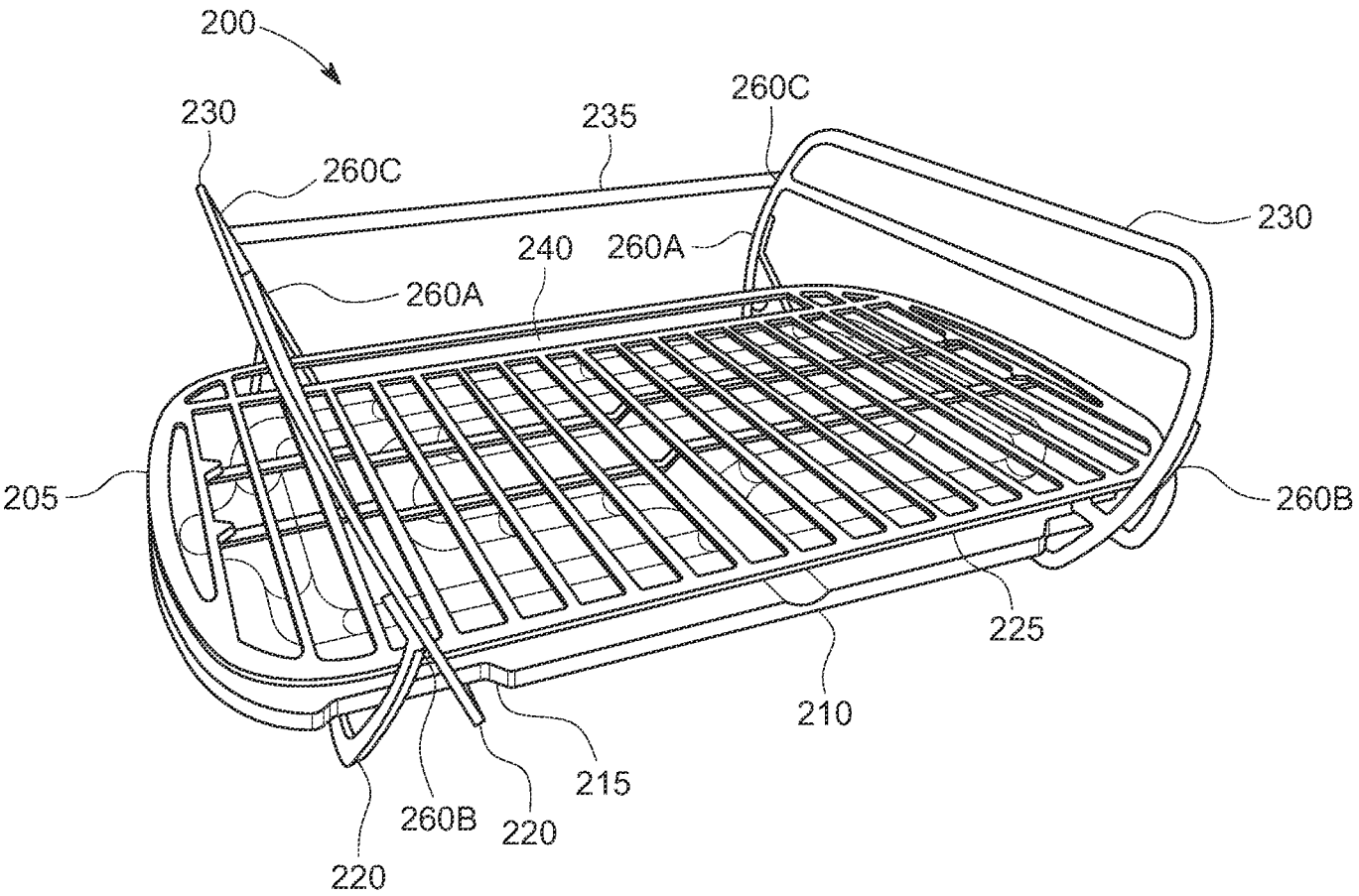
FIG. 9 illustrates an embodiment of the appliance where the legs and rails are welded at connection points.
Figure 10:
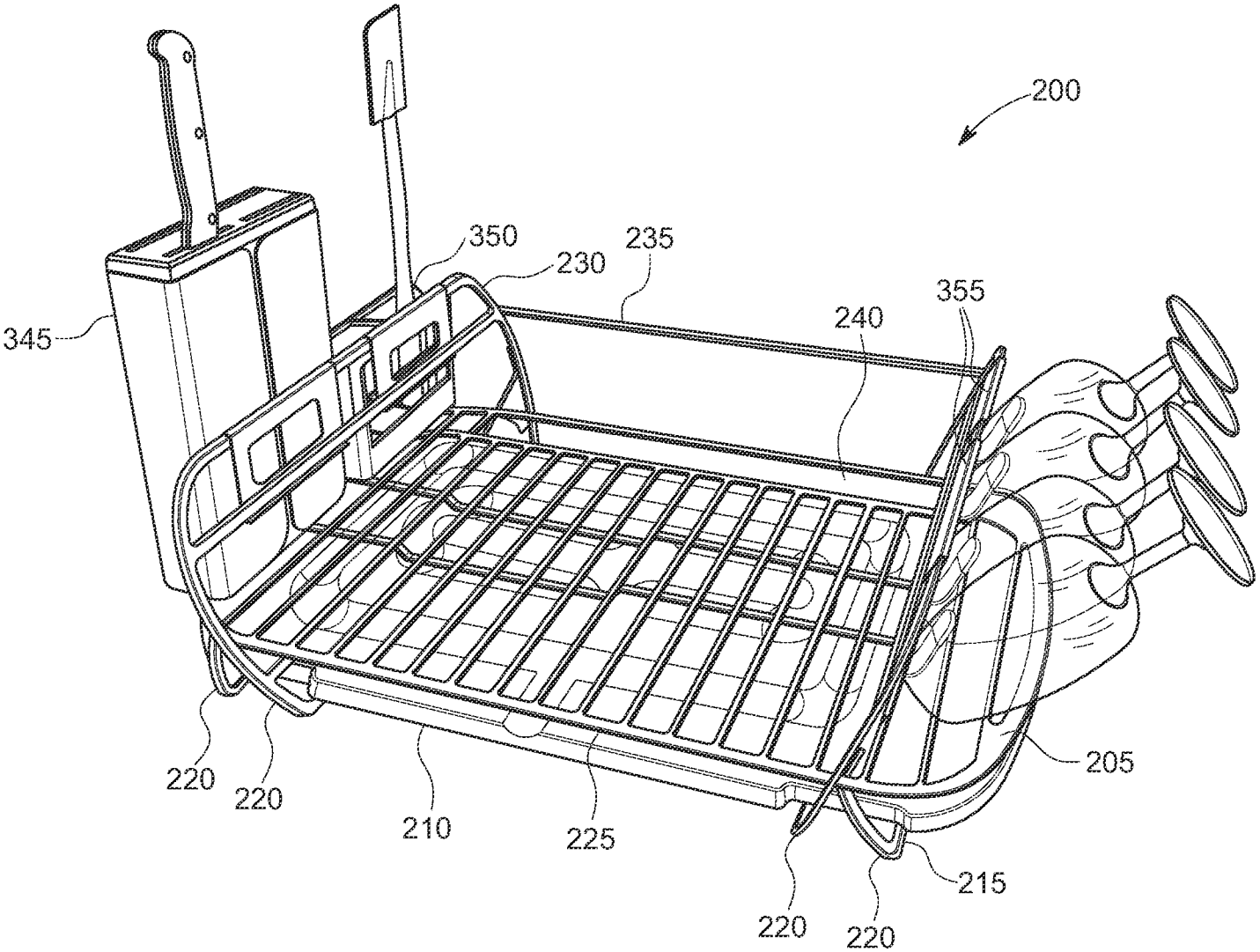
FIG. 10 illustrates the appliance with welded joints including the accessories connected thereto.
Figure 11:
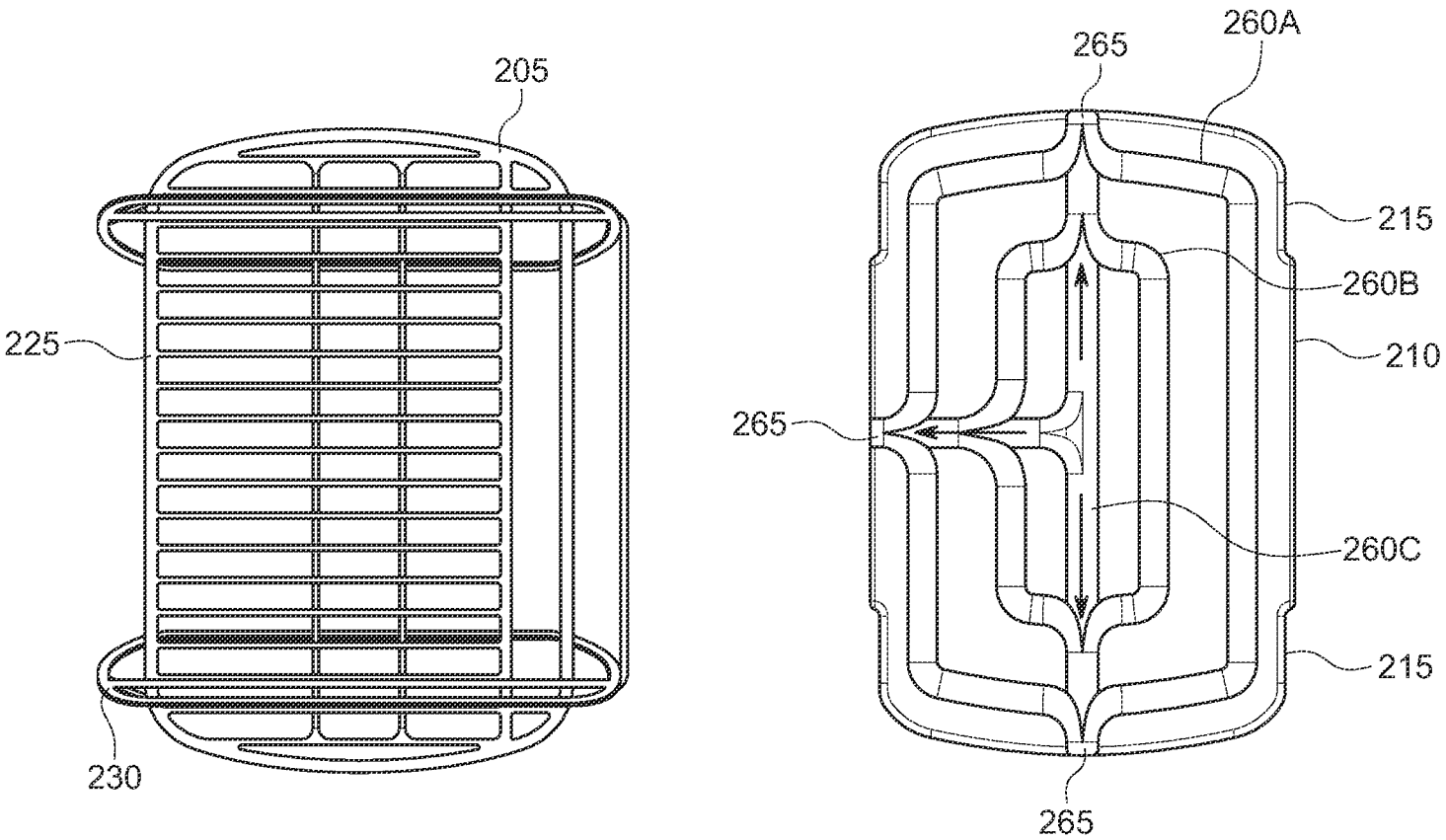
FIG. 11 illustrates a drain tray having channels and spouts for diverting excess rinse water therefrom.

Referring to FIGS. 9-11, the components of a second embodiment of an appliance 200 can include a drying rack 205 with components welded together and a unique design of channels formed within the drain tray 210. However, according to other certain embodiments, one or more components can be attachable or connectable to one another as previously discussed. For example, according to some embodiments one or more components of the drying rack can be connectable via fasteners such as threaded screws or bolts such that they can be packaged or stored in a disassembled manner, then assembled upon use.

For example, according to the embodiment shown in FIGS. 9-11 the drying rack may include six joint locations 260 connectable by welds, screws, bolts, or other fasteners. The joints 260 can include two rear joints 260A, two front joints 260B, and two upper brace joints 260C as illustrated in FIG. 9. As such, the drying rack 205 and its components may be assemblable and disassemblable where detachable fasteners are used.

Referring to FIG. 11, the disassembled drying rack 205 and drain tray 210 are shown. The drain tray 210 can include a series of channels 260 including an outer-most channel 260A, middle channel 260B and inner-most channel 260C. The channels 260 can be interconnected to one or more outlets 265. According to the example shown in FIG. 11, the drain tray 210 can have multiple outlets 265 such that the drain tray 210 may be tilted in different direction using legs or standoffs, for example, so as to selectively choose which direction and outlet 265 for the drain tray to divert water to as shown by the arrows within the channels shown in FIG. 11. The channels 160 can be cut into the diatomaceous earth material of the drying rack 105 in some embodiments after the drying rack is formed as a solid planar sheet.

Referring still to FIGS. 9-11, the drying appliance 200 is shown including drying rack 205 and drain tray 210. The drain tray 210 is similar to the drain tray 110 in that the drain tray 210 is generally rectangular with rounded corners and has four cutouts 215 for accommodating and locating four cantilevered legs 220 of the drying rack 205 thereby securely and precisely placing the drain tray 210 relative to the drying rack 205 when assembled according to some embodiments. The drain tray 210 is made of a diatomaceous earth wicking material as opposed to the molded plastic or rubber polymer material of the prior art thereby more rapidly drawing moisture away from dishes, glassware, and utensils placed upon the drying rack 205. The use of the diatomaceous earth drain tray 210 results in more rapid and complete evaporation of water from the dishes (not shown), drying rack 205, and drain tray 210 as previously discussed.

As compared to the previously discussed assembly 200 embodiment, the location of the assembly 100 relative to a sink, counter, or placement layout may not be as important because the assembly 100 embodiment illustrated omits the one or more drain spouts. Referring again to FIG. 4, the drain tray 110 can include a series of channels 160 including an outer-most channel 160A and a plurality of inner channels 160B. The channels 260 in the first embodiment are not interconnected to one or more outlets as in the second embodiment. According to the example shown in FIG. 4, the inventors of this patent application have found that the channels 160 in combination with the absorptive material of the drain tray 110 render one or more drain spouts unnecessary in some instances where the absorptive attributes of the train tray 110 may be devoid of an outlet where the amount of water dripped onto the absorptive drain tray 110 is absorbed and evaporated without the need for a traditional drain to an underlying sink, for example.

While the above describes the preferred embodiment, the invention so described is not to be so restricted. Other embodiments which utilize the teachings herein set forth art intended to be within the scope and spirit of the subject invention. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A drying appliance, comprising:

drying rack including: (i) a base having a planar surface that is characterized by a width and a length that is greater than its width, the planar surface comprising a plurality of apertures therethrough that include width-wise apertures that extend parallel to the width and at least one length-wise aperture that extends parallel to the length and along a majority of the length; and (ii) a first end support and a second end support, each of which is pivotally attached to the base at opposite ends of its length and pivotable between a height-reduced configuration and a usable configuration; and an absorbent tray comprising diatomaceous earth;

wherein the first end support and the second end support are configured to support, in the usable configuration, the absorbent tray below the drying rack and above and spaced apart from a surface on which the drying rack is disposed, such that air can circulate above and below the absorbent tray; and wherein the absorbent tray is configure to absorb water that drips onto it from wet articles that are placed on the drying rack and is devoid of any outlet for draining the water from its surface.

2. The drying appliance according to claim 1, wherein the absorbent tray is configured to wick moisture within the absorbent tray and away from a surface of the absorbent tray upon which the water drips.

3. The drying appliance according to claim 1, wherein each of the first end support and the second end support includes two upwardly extending rails coupled to two downwardly extending legs, the two upwardly extending rails coupled to each other with one or more transverse rails, the two downwardly extending legs comprising inwardly extending seats.

4. The drying appliance according to claim 3, further comprising a drying accessory configured to be removably coupled to the one or more transverse rails.

5. The drying appliance according to claim 3, further comprising a plurality of interchangeable drying accessories, each of the plurality of interchangeable drying accessories being configured to be removably coupled to the one or more transverse rails.

6. The drying appliance according to claim 5, wherein the plurality of interchangeable drying accessories include one or more glassware hangers for hanging glassware thereon.

7. The drying appliance according to claim 6, wherein the one or more glassware hangers each include a polymer cover disposed over an end thereof to protect and cushion glassware place thereon for drying.

8. The drying appliance according to claim 5, wherein the plurality of interchangeable drying accessories include a utensil compartment for placement of washed utensils therein.

9. The drying appliance according to claim 5, wherein the plurality of interchangeable drying accessories include a knife drying accessory, wherein the knife drying accessory includes a wooden portion and a cushioning polymer portion, the cushioning polymer portion being configured to provide an internal cushion for a tip of a knife.

10. The drying appliance according to claim 1, wherein, in the height-reduced configuration, the first end support and the second end support are pivoted close to the base; and wherein in the usable configuration, the first end support and the second end support are pivoted away from the base, such that the downward extending legs are disposed below the base and configured to support the base above a surface on which the drying rack is disposed.

11. The drying appliance according to claim 1, further comprising a secondary base disposed below the base, the secondary base including apertures therethrough, a length of the apertures of the secondary base being shorter than the width-wise apertures of the base, the base and secondary base being configured to allow kitchenware to extend partially through the base and be supported by both the base and the secondary base.

12. The drying appliance according to claim 3, wherein the inwardly extending seats are configured to support the absorbent tray above and spaced apart from the surface on which the drying rack is disposed.

13. The drying appliance according to claim 1, wherein the absorbent tray is configured to allow the water to evaporate from an entire outer surface of the absorbent tray.

14. The drying appliance according to claim 1, wherein the absorbent tray comprises one or more channels extending into and along a top surface of the absorbent tray, wherein the one or more channels wick moisture within the absorbent drain tray and away from the top surface of the absorbent drain tray upon which the water drips.

15. The drying appliance according to claim 14, wherein the absorbent tray has a constant peripheral thickness.

16. The drying appliance according to claim 1, wherein the absorbent tray is substantially flat along its length and width.

17. The drying appliance according to claim 3, wherein the absorbent tray is generally rectangular and has cutouts configured to accommodate the two downwardly extending legs of the each of the first end support and the second end support.

18. The drying appliance according to claim 12, wherein the absorbent tray is generally rectangular and has cutouts configured to accommodate the two downwardly extending legs of the each of the first end support and the second end support.

19. The drying appliance according to claim 18, wherein the cutouts are further configured to locate the drain tray relative to the drying rack when the drain tray is disposed on the inwardly extending seats.

20. The drying appliance according to claim 1, further comprising at least at least one removably connectable lateral rail that removably couples the first end support and the second end support in the usable configuration.

21. A drying appliance, comprising:

a drying rack including: (i) a base having a planar surface that is characterized by a width and a length that is greater than its width, the planar surface comprising a plurality of apertures therethrough that include width-wise apertures that extend parallel to the width and at least one length-wise aperture that extends parallel to the length and along a majority of the length; (ii) a first end support and a second end support, each of which is pivotally attached to the base at opposite ends of its length and pivotable between a height-reduced configuration and a usable configuration; and (iii) at least one removably connectable lateral rail that removably couples the first end support and the second end support in the usable configuration; and an absorbent tray comprising diatomaceous earth;

wherein each of the first end support and the second end support includes two upwardly extending rails coupled to two downward extending legs, the two upwardly extending rails coupled to each other with a transverse rail, the two downward extending legs comprising inward-extending seats;

wherein, in the height-reduced configuration, the first end support and second end support are pivoted close to the base, and wherein in the usable configuration, the first end support and second end support are pivoted away from the base, such that the downward extending legs are disposed below the base and configured to support the base above a surface on which the drying rack is disposed;

wherein the removably connectable lateral rail is configured to removably couple transverse rails of the first end support and the second end support;

wherein the absorbent tray is configured to be disposed on the inwardly-extending seats when the first end support and second end support are in the usable configuration;

wherein, the inwardly-extending seats are configured to support the absorbent tray above the surface, such that air can circulate above and below the absorbent tray; and wherein the absorbent tray is configured to absorb water that drips onto it from wet dishes or articles that are placed above it on the drying rack, and wherein the absorbent tray is devoid of any outlet for draining the liquid from its surface.

* * * * *